United States Patent [19]

Grewe et al.

[11] 4,119,877

[45] Oct. 10, 1978

[54] ELECTRIC LAMP HAVING A CAP PLATE

[75] Inventors: Franz Josef Grewe; Heinz Rösler; Oskar Rühl, all of Aachen; Klaus Stenke, Eschweiler, all of Fed. Rep. of Germany; Egidius Van Wersch, Voerendaal, Netherlands; Leo Wings, Dürwiss, Fed. Rep. of Germany

[73] Assignee: U.S. Philips Corporation, New York, N.Y.

[21] Appl. No.: 715,515

[22] Filed: Aug. 18, 1976

[30] Foreign Application Priority Data

Aug. 23, 1975 [DE] Fed. Rep. of Germany ... 7526777[U]

[51] Int. Cl.[2] ..... H01J 5/48; H01J 5/50

[52] U.S. Cl. ..... 313/318; 339/125 L; 339/145 R

[58] Field of Search ..... 313/318; 339/145 D, 339/52 S, 55, 56, 145 R, 125 L, 258 R

[56] References Cited

U.S. PATENT DOCUMENTS

| | | | |
|---|---|---|---|
| 3,173,735 | 3/1965 | Fenn | 313/318 X |
| 3,327,281 | 6/1967 | Johnson | 339/56 |
| 3,739,221 | 6/1973 | DeBleyker et al. | 313/318 |
| 4,012,658 | 3/1977 | Vause | 313/318 |
| 4,013,335 | 3/1977 | Varkonyi et al. | 313/318 |

*Primary Examiner*—Saxfield Chatmon, Jr.
*Attorney, Agent, or Firm*—Frank R. Trifari; Robert S. Smith

[57] ABSTRACT

In an automobile incandescent lamp the pinch cooperates with a cap plate which consists of a resilient material and is coupled to the pinch lugs engaging the pinch.

10 Claims, 13 Drawing Figures

ELECTRIC LAMP HAVING A CAP PLATE

The invention relates to an electric lamp, in particular a motor-car incandescent lamp, whose envelope has a pinch which is rectangular in cross-section and which is secured in a rectangular recess of a metal cap plate between lugs stamped out of and extending from the plate. The cap plate is connected in the usual manner to a cylindrical lamp cap by soldering or other mechanical joining means (German Utility Model 7,306,678).

In the known lamps of this type the cap plate is connected to the pinch by cement. Since the said cement works loose in the course of time, in particular in motor-car lamps, the lamp pinch has been provided with a metal sleeve to which the cap plate was welded (German Utility Model 7,334,878 and German Offenlegungsschrift No. 1,930,786). However, such an arrangement is complicated and expensive.

It is the object of the invention to provide a sure connection between cap plate and lamp pinch which can be manufactured in a simple and inexpensive manner without additional means.

According to the invention this object is achieved in an electric lamp of the kind mentioned in the preamble in that the cap plate consists of resilient material and is coupled to the lamp pinch via the lugs extending from the plate resiliently engaging said pinch.

As a result of this it is achieved that the cap plate is rigidly secured to the lamp pinch only due to its resilient properties.

Preferably two lugs are provided whose length corresponds to half the width of the recess in the cap plate and which hold the pinch on its longitudinal sides.

The resilient lugs preferably continue into the flat cap plate. This means that the cut in the cap plate in the region of the wide side of the rectangular recess in the plate extends into the flat part of the plate which cannot be forced out.

In order to achieve a greater spring action, the two lugs may be divided into a number of narrow resilient flaps which advantageously are twisted.

According to another embodiment of the lamp the cap plate has a meandering shape of zig-zag-shaped cut so that rectangular or triangular flaps are formed whose length corresponds to the width of the recess in the cap plate and which, when forced out of the cap plate at right angles, hold the pinch on its longitudinal sides.

According to a preferred embodiment of the lamp according to the invention prestressed flaps are also forced out of the cap plate on the narrow sides of the recess of the cap plate, which flaps hold the pinch on its narrow sides. In this manner a movement of the lamp in the transverse direction is avoided.

An excellent fixing of the lamp against the cap plate in the longitudinal direction is achieved when according to a further embodiment of the invention the pinch has a stud behind which the resilient lugs or flaps snap into engagement when the cap plate is slid on.

The longitudinal sides of the pinch are preferably provided with knurls extending transversely to the longitudinal axis of the lamp. An even surer connection of the cap plate to the lamp pinch is achieved when the two lugs are curved concave with respect to the pinch and engage the pinch only with their corners in the region of the knurls.

In order to achieve a position of the lamp in the cap plate which is defined in height, according to a further embodiment of the invention studs which bear on the cap plate and formed on the end of the pinch facing the lamp.

In order to enable an easier sliding-on of the cap plate on the pinch, the pinch may taper towards its free end.

The invention will now be described in greater detail with reference to a few examples shown in the drawing.

FIGS. 1*a*, 1*b*, 1*c*, 2*a*, 2*b*, 2*c*, 3*a*, 3*b* and 3*c* show various embodiments involving the connection of a cap plate to a lamp pinch in lamps according to the invention. These figures show the cap plate, the side elevation of the lamp pinch with cap plate provided thereon and a cross-section through the lamp pinch.

Figure 1A:
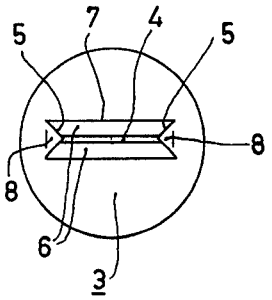
Figure 1B:
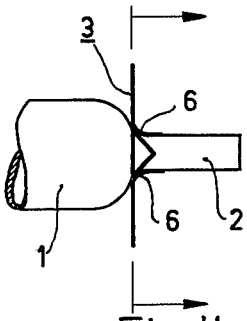
Figure 1C:
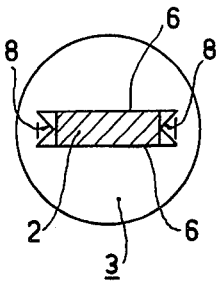

Referring now to FIGS. 1*a*, 1*b*, 1*c*, 2*a*, 2*b*, 2*c*, 3*a*, 3*b*, and 3*c*; an envelope 1, for example of quartz glass, of a motor-car incandescent lamp having a rectangular pinch 2 has current supply conductors (not shown) embedded therein. A metal cap plate 3 is positioned on the lamp pinch 2 and consists of a material having long-acting resilience even at temperatures up to 300° C., for example, German silver or a copper-nickel alloy. The thickness of the cap plate 3 is approximately 0.5 mm with a diameter of for example 25 mm.

The cap plates are provided with different cuts by means of a pinching tool. For example, the cap plate 3 shown in FIGS. 1*a*, 1*b* and 1*c* comprises a central longitudinal cut 4 adjoining two small angular cuts 5. As a result of this two lugs 6 are formed whose length corresponds to half the width of the recess 7 in the cap plate which is formed when the lugs 6 are forced at right angles out of the cap plate 3. As a result of the angular cuts 5 small triangular prestressed lugs 8 are formed on the narrow sides of the recess 7 of the cap plate and are also forced at right angles out of thecap plate. The cap plate 3 thus manufactured is slid on the lamp pinch 2 in which the two lugs 6 hold the pinch 2 on its longitudinal sides, while the small triangular lugs 8 hold the pinch 2 on its narrow sides. The cap plate 3 thus is coupled to the lamp pinch 2 only by the resiliently engaging lugs 6 and 8.

Figure 2A:
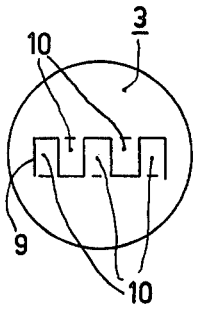
Figure 2B:
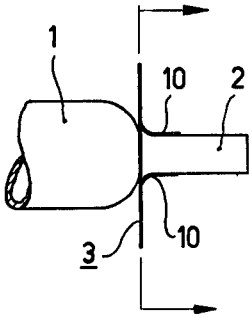
Figure 2C:
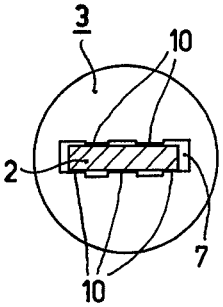

In the embodiment shown in FIGS. 2*a*, 2*b* and 2*c* the cap plate 3 has a meandering shape or meander-shaped cut 9 so that rectangular flaps 10 are formed whose length (which might also be considered the height) corresponds to the width of the recess 7 in the cap and which, when forced at right angles out of the cap plate 3, hold the pinch 2 on its longitudinal sides. The cut 9 may also be formed in a zig-zag manner so that three triangular flaps 10 are formed.

Figure 3A:
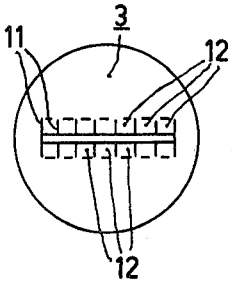
Figure 3B:
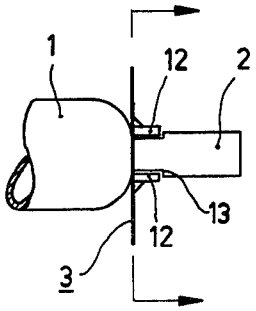
Figure 3C:
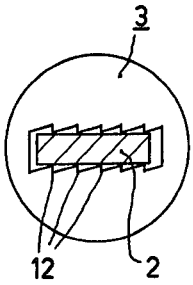
Figure 4:
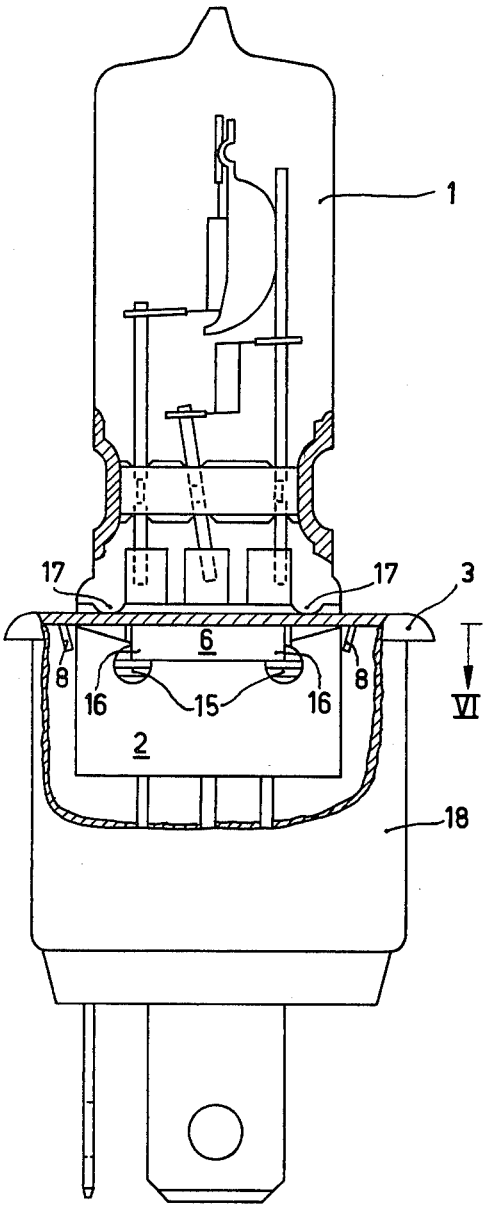
FIGS. 4 and 5 show two longitudinal sectional views rotated through 90° through a lamp with a cap according to the invention.
Figure 5:
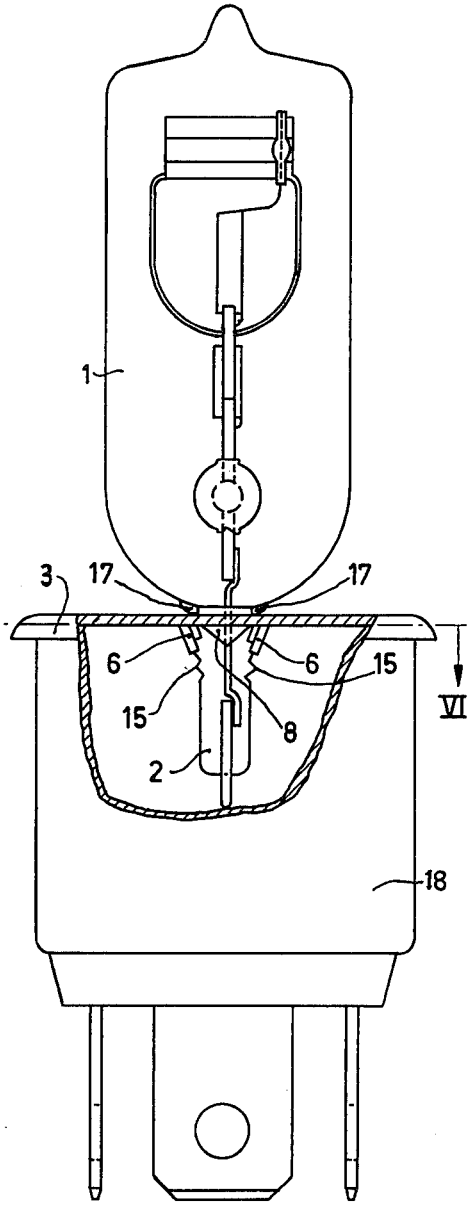
Figure 6:
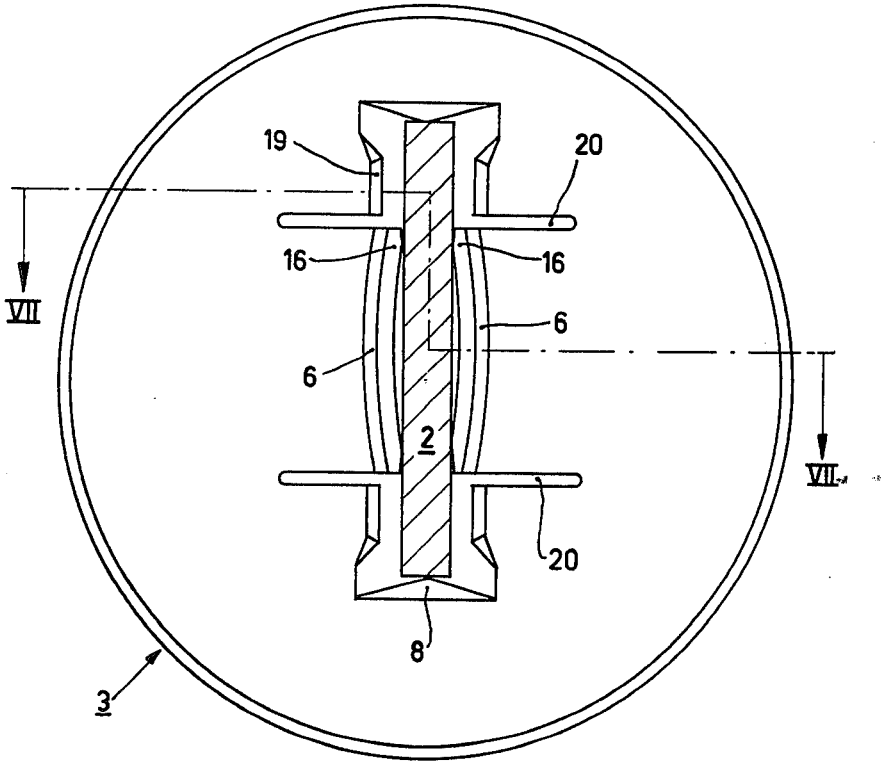
FIG. 6 is a cross-sectional view through the lamp pinch taken on the line VI—VI of FIG. 5.
Figure 7:
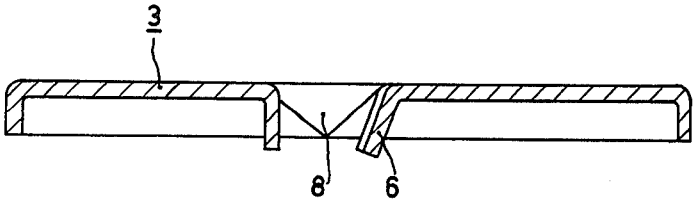
FIG. 7 is a sectional view taken on the line VII—VII of the cap plate used in FIG. 4 to 6.

In the lamp shown in FIGS. 3*a*, 3*b* and 3*c* the two longitudinal lugs 6 of FIG. 1 are divided into a number of narrow spring flaps 12 by corresponding cuts 11 in the transverse direction which, after forcing out of the cap plate 3 and after sliding the cap plate on the lamp pinch 2, hold the pinch on its longitudinal sides. In order to increase the grip, the individual spring flaps 12 are twisted about the longitudinal axes thereof.

In order to avoid a movement in the longitudinal direction between the lamp envelope 1 and the cap plate 3, the pinch 2 in the embodiment shown in FIG. 3 has a stud 13 behind which the spring flaps 12 snap into engagement with the cap plate 3.

In FIGS. 4 to 7 parts corresponding to those of FIGS. 1 to 3 are referred to by the same reference numerals. In the halogen motor-car headlight shown in FIGS. 4 to 6 the lamp pinch 2 comprises on its longitudinal sides knurls 15 extending transversely to the longitudinal axis of the lamp. The two longitudinal lugs 6 of the cap plate 3 are curved concave with respect to the pinch 2 and engage only with their corners or edges 16 the pinch 2 in the region of the knurls 15 (FIG. 6) In this case the resilient lugs 6 extend into the flat area of the cap plate 3 as a result of corresponding cuts 20 in the cap plate 3 so that the resilient properties of the lugs 6 are increased. On its narrow sides the pinch 2 in this case also is held by small triangular prestressed lugs 8.

At the end of the pinch 2 facing the lamp two studs 17 are formed which bear on the cap plate 3 in the area 19. The cap plate 3 is connected in known manner to a cylindrical lamp cap 18.

What is claimed is:

1. An automobile electric lamp which comprises: an envelope having a bulbous portion and a pinch which is rectangular in cross-section and which has first, second, third, and fourth sides, said first and third sides opposed, said second and fourth being opposed sides which are wider than said first and third sides, a filament disposed within said envelope and a metal cap plate having a rectangular recess having a lug stamped out of the plate disposed on each side of said recess, said cap plate being a resilient material and being coupled to each side of said pinch by the resilient engagement of said lugs, said lugs extending from said cap plate in a direction generally away from said bulbous portion.

2. A lamp as claimed in claim 1 wherein said lugs on the second and fourth sides have a height dimension which is substantially equal to half the width of said recess of said cap plate.

3. A lamp as claimed in claim 2 wherein each of said lugs are separated into a plurality of discrete resilient flaps.

4. A lamp as claimed in claim 3 wherein said discrete resilient flaps are rotated about an axis extending from said cap plate.

5. A lamp as claimed in claim 1 wherein said cap plate has slot having a meandering shape defining discrete lug segments having a length substantially equal to the width of said recess of said cap plate and which hold the pinch on said first and second sides.

6. A lamp as claimed in claim 1 where said pinch includes a stud extending in a direction which is aligned generally with one side of said pinch and said lug is configured and dimensioned for locking engagement.

7. A lamp as claimed in claim 6 wherein said pinch has knurls on said second and fourth sides extending transversely to the longitudianl axis of said lamp.

8. A lamp as claimed in claim 7 wherein said lugs engaging said second and fourth sides of said pinch are concave with respect to the pinch and engage the knurls in said pinch only with their edges.

9. A lamp as claimed in claim 6 further including at least two studs disposed at the end of the pinch nearest the lamp which contacts said cap plate when said envelope and said cap plate are assembled.

10. A lamp as claimed in claim 6 wherein said pinch is tapered to a smaller thickness at the free end thereof.

* * * * *